US005456452A

United States Patent [19]

Soofi

[11] Patent Number: 5,456,452

[45] Date of Patent: Oct. 10, 1995

[54] APPARATUS FOR MAKING STEEL ALLOYS IN A TUNDISH

[75] Inventor: Madjid Soofi, St. Charles, Ill.

[73] Assignee: Magneco/Metrel, Inc., Addison, Ill.

[21] Appl. No.: 315,935

[22] Filed: Sep. 30, 1994

Related U.S. Application Data

[62] Division of Ser. No. 179,930, Jan. 11, 1994, Pat. No. 5,391,348.

[51] Int. Cl.[6] ..... C21B 3/04

[52] U.S. Cl. ..... 266/200; 75/526; 266/229

[58] Field of Search ..... 75/526; 266/200, 266/229

[56] References Cited

U.S. PATENT DOCUMENTS

| | | | |
|---|---|---|---|
| 2,595,292 | 5/1952 | Reece | 75/122 |
| 3,137,753 | 6/1964 | Feichtinger | 75/526 |
| 4,632,368 | 12/1986 | Podrini | 266/229 |
| 4,761,178 | 8/1988 | Griffing | 75/526 |
| 4,773,929 | 9/1988 | Weiner | 75/526 |

*Primary Examiner*—Peter D. Rosenberg

*Attorney, Agent, or Firm*—Maxwell J. Petersen; Willian Brinks Hofer Gilson & Lione

[57] ABSTRACT

A method and apparatus are provided for making steel alloys directly in a tundish. Base steel enters the tundish from a ladle. An alloying chamber having a plurality of inlets is positioned above a tundish drain. An alloying material (for example, a wire including one or more alloying ingredients) is fed into the alloying chamber through a feed pipe originating above the liquid level in the tundish. Molten base steel enters the alloying chamber through the inlets and is mixed with the alloying material to make a steel alloy, which exits through the drain. The method and apparatus are especially suitable for making small order quantities of alloy steel of less than one ladle volume.

14 Claims, 3 Drawing Sheets

APPARATUS FOR MAKING STEEL ALLOYS IN A TUNDISH

This application is a division of application Ser. No. 08/179,930, filed Jan. 11, 1994, now U.S. Pat. No. 5,391, 348.

FIELD OF THE INVENTION

This invention relates to a method and apparatus for combining base steel with alloying ingredients in-line, in a tundish vessel, to make various steel alloys.

BACKGROUND OF THE INVENTION

Large steel mills have conventionally made batches of steel alloys in ladles. To make steel alloys, base steel has been combined with various alloying elements, for example, copper, manganese, chromium, zinc, nickel and/or cobalt, in batch ladles having batch sizes typically exceeding 200 tons. It is economically inefficient to produce less than a full batch of a particular grade of alloy steel, in a ladle. Therefore, it has been a common practice of large steel companies not to accept an order of less than one ladle batch, for a particular grade of steel.

Notwithstanding the previous difficulty for large steel companies to produce small order quantities, there has always been some demand for small order quantities of steel alloys by steel consumers. In the past, these smaller orders have been filled by specialty producers using smaller ladles, etc. In more recent years, the demand for smaller order quantities of steel alloys has risen sharply while the demand for larger order quantities has levelled off or fallen. As a result, there is increasing pressure on large steel companies to develop or obtain suitable, economically efficient techniques for producing smaller order quantities (i.e., less than 200-ton batch sizes) of steel alloys.

Another problem faced by large steel companies, particularly associated with intermediate order sizes of one or a few ladles, has been the loss of steel during production transition from one alloy grade to another. After a steel alloy is produced in a ladle, the molten steel is fed to a tundish vessel for purification of the steel and distribution to various casting machines and/or molds. In a typical large steel mill, a single tundish is selectively fed from more than one, and often several, different ladles, each containing a different grade of steel.

When switching a tundish from one ladle to another, the rate of flow into the tundish from the first ladle is gradually lowered until the level of molten steel in the tundish significantly drops. For example, the rate of flow into a 55-ton tundish vessel may be lowered from five tons per minute to two tons per minute until the level of molten steel in the tundish drops to below 25 tons. Once this lower level is achieved, the flow into the tundish from the first ladle is stopped and the flow from the second ladle is commenced, initially at a low flow rate sufficient to just maintain the lower level of molten steel in the tundish.

This low flow rate is maintained until substantially all (i.e. a target percentage) of the molten steel in the tundish has been replaced by steel from the second ladle. Thereafter, the flow to the tundish from the second ladle is gradually increased to, for example, five tons per minute, and the level of steel in the tundish is allowed to rise back to 55 tons. During this transition from the first ladle to the second ladle, a quantity of steel (for example, 20 tons) is lost because this steel is an unsalable mixture of steel from the first and second ladles. In order to more efficiently produce intermediate quantities of steel alloys, there is also a demand for processing techniques which reduce this transition loss in the tundish.

SUMMARY OF THE INVENTION

The present invention is a method and apparatus for making steel alloys in a tundish vessel which eliminates the above disadvantages of prior art steelmaking processes and provides an effective, economically efficient way for large steelmakers to fill small quantity orders using existing equipment. A grade of base steel is made in a conventional ladle. The term "base steel" is defined herein as an intermediate grade of steel which has at least some elements in common with more than one alloy. Unlike conventional processes, the alloying ingredients (i.e., the ingredients which distinguish one grade of finished alloy steel from another) are not added into the ladle.

The base steel is fed from the ladle to a conventional tundish, in the same manner as finished steel would be fed in a conventional process. The tundish performs its standard function of purifying the base steel by allowing and causing impurities to float to the top of the vessel for removal. The tundish also channels the base steel toward one or more drains which ultimately distribute the steel into one or more casting processes or molds.

Located above each drain, and surrounding each drain, is a device referred to herein as an alloying chamber. The alloying chamber includes one or more walls extending upward from the drain and surrounding the drain, a first major opening at or above the drain, a second major opening above the first major opening, and an alloy material feed system communicating with the second major opening. The alloying chamber also includes one or more minor openings in communication with the interior of the tundish vessel.

The alloying material feed system includes a material source, for example, a wire source or reel located above the tundish vessel, or above the level of molten metal in the tundish, and a feed pipe communicating with the material source and the second major opening in the alloying chamber. Molten base steel enters the alloying chamber through the minor openings at a steady rate determined by the sizes and number of the minor openings and by the surrounding pressure from the molten base steel in the tundish. At the same time, wire having a predetermined composition of alloying ingredients is fed to the alloying chamber at a predetermined steady rate, using the wire feed system.

The wire entering the alloying chamber melts upon contacting the molten base steel, and is caused to mix with the molten base steel on a continuous basis. Mixing of the alloying ingredients with the base steel can be facilitated by bubbling an inert gas, for example, argon, into the alloying chamber through the drain nozzle. Mixing can also be facilitated by placing an electromagnetic stirrer in the alloying chamber or in the drain nozzle below the alloying chamber. There is ample residence time in the alloying chamber to mix the molten ingredients before the steel alloy product leaves the alloying chamber through the drain nozzle.

After a sufficient quantity of a steel alloy has been made, the production can be switched to a different steel alloy by simply switching to a different alloy ingredient wire having a different predetermined composition. The transition time is greatly reduced from prior art methods, and the quantity of steel lost during transition is minimized.

With the foregoing in mind, it is a feature and advantage of the invention to provide an apparatus for making steel alloys which combines the alloying ingredients with the base steel material in the tundish and not in ladles, thereby alleviating the need to switch from one ladle to another, or lower the liquid level in the tundish, when changing alloys.

It is also a feature and advantage of the invention to provide a method of making steel alloys which substantially eliminates the transition time required to switch from one alloy to another.

It is also a feature and advantage of the invention to provide a method and apparatus for making steel alloys which permit large steel mills to meet small order quantities of alloys effectively and economically using existing equipment.

It is also a feature and advantage of the invention to provide a method and apparatus for making steel alloys which greatly reduce the amount of unsalable steel generated during transition between alloys.

The foregoing and other features and advantages of the invention will become further apparent from the following detailed description of the presently preferred embodiments, read in conjunction with the accompanying examples and drawings. The detailed description, examples and drawings are merely illustrative rather than limiting, the scope of the invention being defined by the appended claims and equivalents thereof.

DETAILED DESCRIPTION OF THE PRESENTLY PREFERRED EMBODIMENTS

Figure 2:
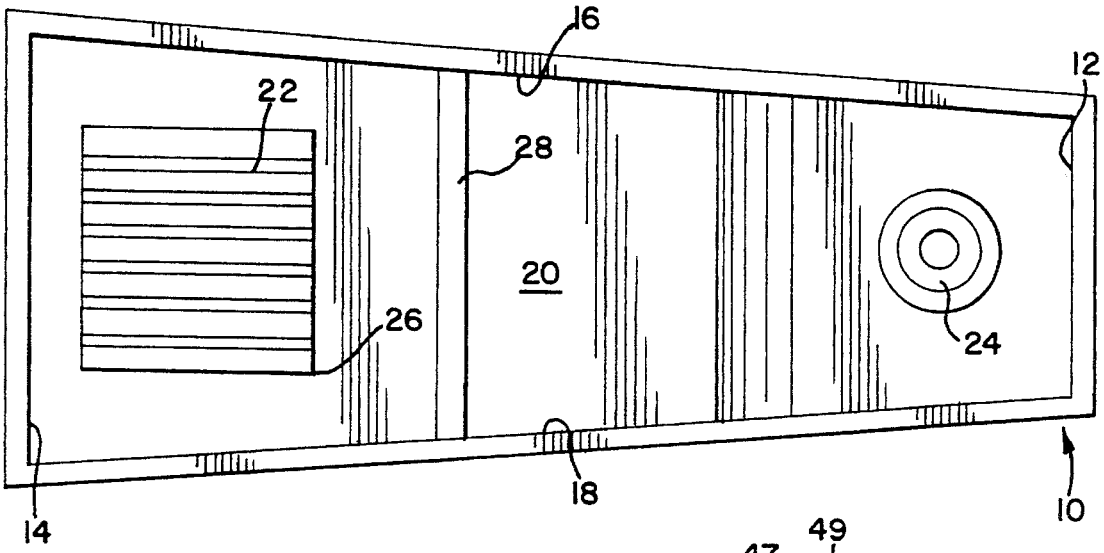
FIG. 2 is a top view of a tundish vessel.

Referring to FIG. 2, a standard tundish vessel 10, of a type known in the art, has a front wall 12, a back wall 14, two side walls 16 and 18, and a floor 20 including a region of impact 22 and a drain 25. An impact pad 26 having a sinusoidal upper surface is positioned in the region of impact 22. The impact pad 26 reduces and minimizes the turbulence and splashing caused by molten metal entering the tundish. An upright tundish baffle 28, extending between the side walls 16 and 18 and having a plurality of flow control openings therein, regulates the flow of molten metal from the impact region 22 toward the drain 26.

Figure 1:
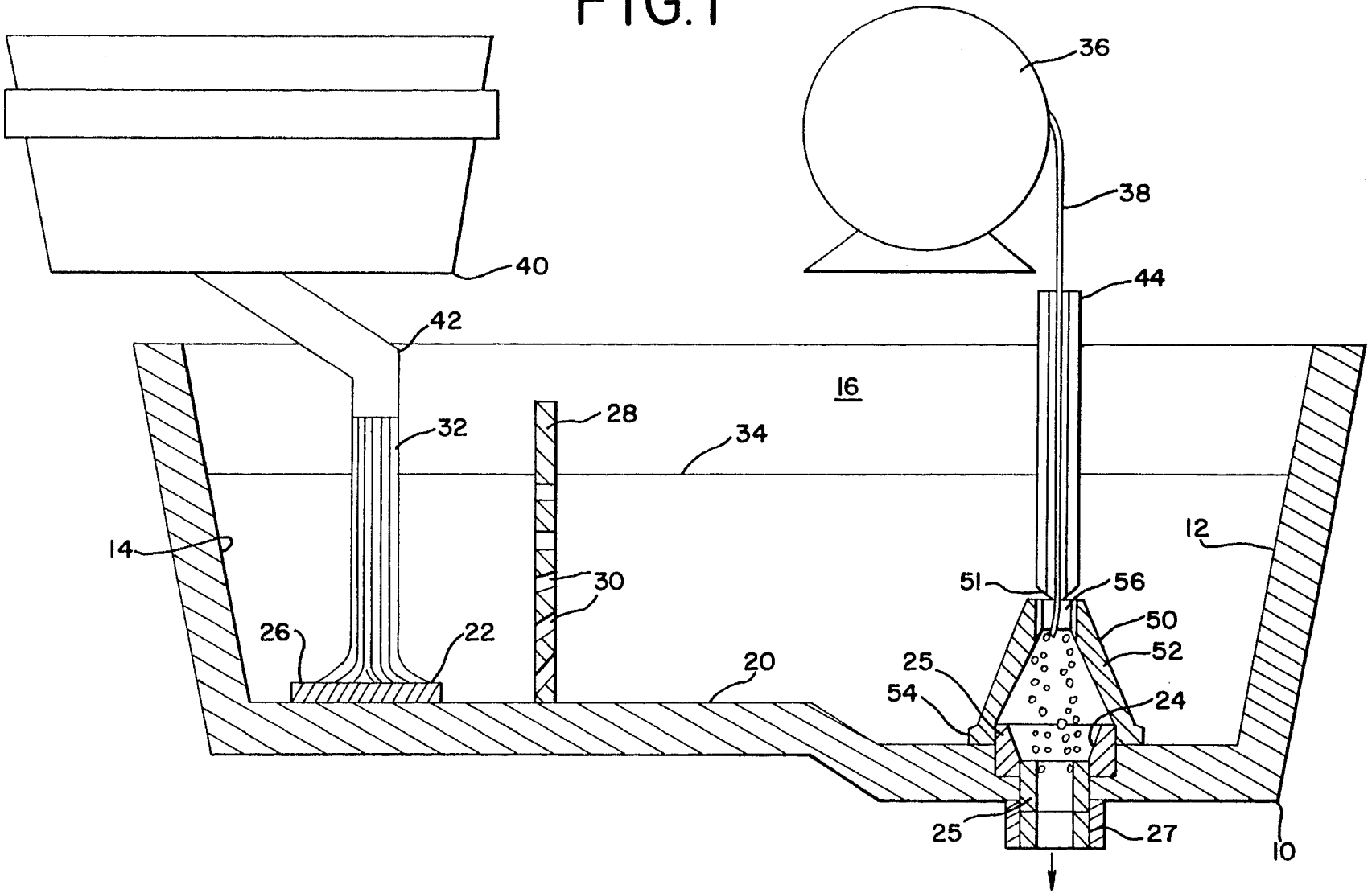
FIG. 1 is a side schematic view of a ladle and tundish vessel with a single drain, employing the alloying chamber of the invention, partially shown in section.

Referring to FIG. 1, the tundish 10 is used in combination with a ladle 40 which feeds molten metal 32 into the tundish 10, at a continuous rate. The ladle 40 has a spout 42 which empties above the impact region 22 in the tundish 10. Various ladles are known in the art and the structure or type of the ladle 40 is not important to the invention. When the tundish 10 and ladle 40 are at steady state, the level of liquid metal in the tundish is defined by a line 34. At this liquid level, the flow rate of finished metal leaving the tundish through the drain 24 is about the same as the overall flow rate of metal entering the tundish.

For purposes of the invention, the molten metal 32 entering the tundish 10 from the ladle 40 is a base grade of steel, defined as any grade of steel which can be used to make a plurality of different alloys by merely adding the various alloying ingredients. For example, the base steel may include mostly iron and minor (e.g. trace) amounts of phosphorous, sulfur, silicon and nitrogen, and other common ingredients. The base steel can be transformed into different steel alloys by adding, for example, appropriate amounts of one or more of cobalt, titanium, nickel, cadmium, vanadium, chromium, chromium oxide, copper, boron, antimony, molybdenum and/or tin.

The base steel is processed in the tundish 10, i.e., its flow is regulated by the baffle 28 such that alumina inclusions and other impurities rise to the top and the purified base steel approaches the drain 24. Located above the drain 24, and surrounding the drain 24, is an alloying chamber 50. The alloying chamber 50 makes it possible to combine the base steel with alloying ingredients in the tundish, such that the base steel is converted into a steel alloy just before the steel leaves the tundish.

Figure 5:
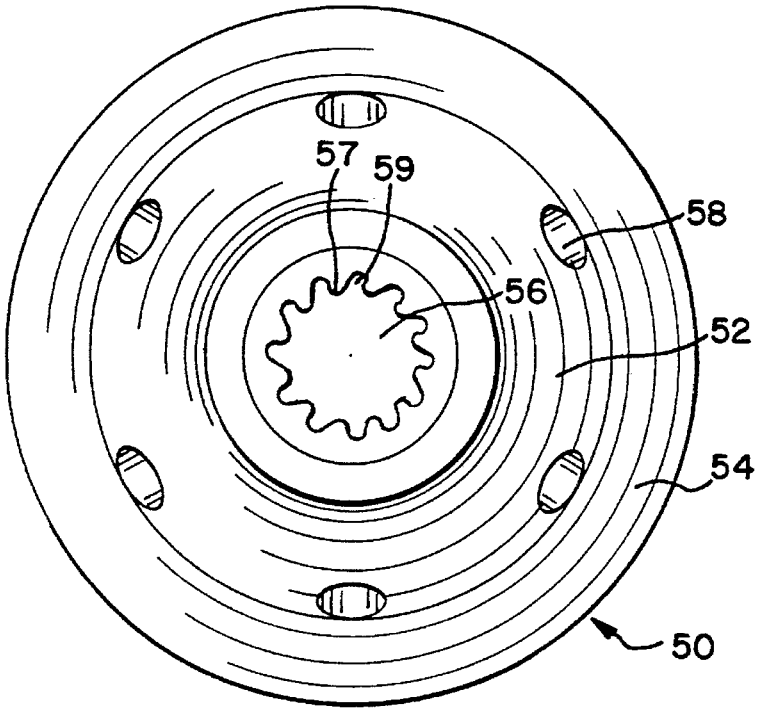
FIG. 5 is a top view of the alloying chamber shown in FIG. 1.
Figure 6:
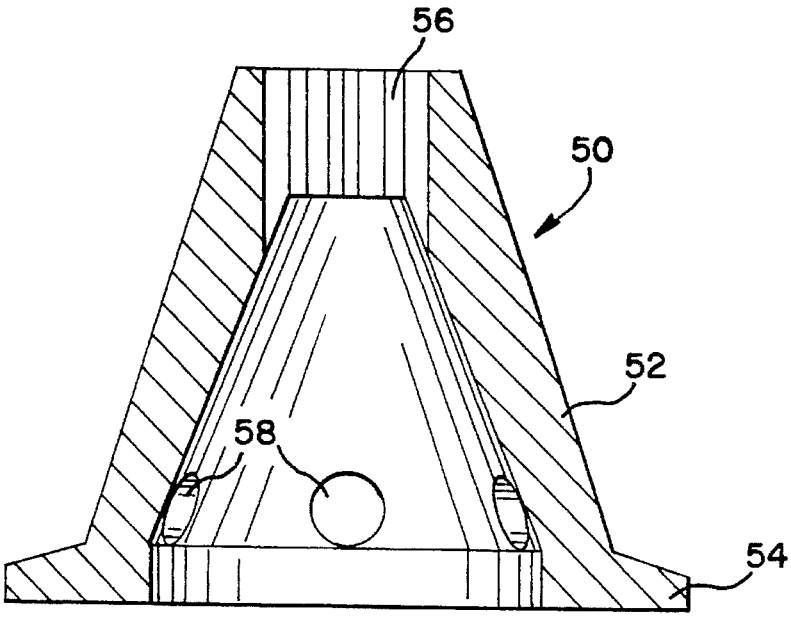
FIG. 6 is a side sectional view of the alloying chamber shown in FIG. 5.

Referring to FIGS. 5 and 6, the alloying chamber 50 includes an inverted conical wall portion 52, a lower flange 54 at the base of the wall, an alloy ingredient feed inlet 56 at the top of the wall, and one or more base steel feed inlets 58 in the wall 52. Preferably, a plurality of base steel feed inlets 58 are located around the perimeter of the wall 52, near the bottom of the wall 52, where the base steel is purest. As shown in FIG. 1, the flange 54 of the chamber 50 opens into the drain 24 from the chamber 50 and is adapted to fit snugly around the upper lip 25 of the drain nozzle 24. This permits the steel alloy produced in the alloying chamber 50 to flow into and through the drain nozzle 24 with little no leakage of the steel alloy back into the main body of the tundish 10.

Figure 4:
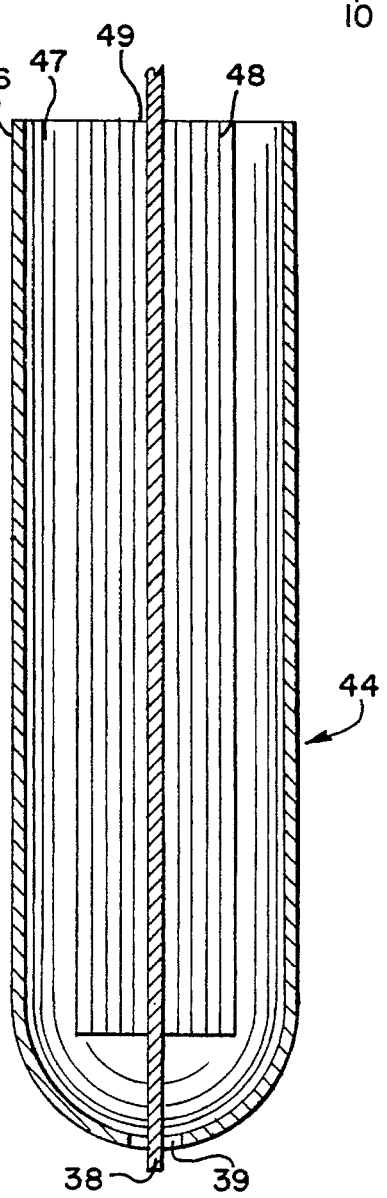
FIG. 4 is a side sectional view of the feed pipe of FIG. 3.
Figure 3:
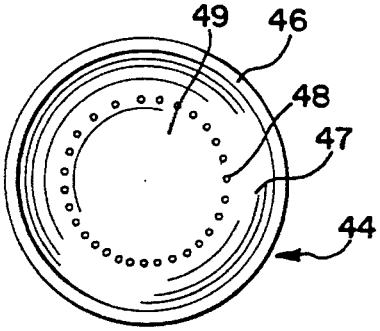
FIG. 3 is a top view of the feed pipe shown in FIG. 1.

Referring to FIGS. 1, 3 and 4, an alloy ingredient wire 38 is fed from a wire feeder 36 located above the tundish 10, through a feed pipe 44 extending vertically from above the tundish 10 to just above the alloying chamber 50, and into the alloying chamber 50 through the alloy ingredient feed inlet 56. The wire feeder 36 can be any conventional automated wire feeder known in the art, for example, an automated spool. The details of the wire feeder 36 are not important. However, it is important that the wire feeder 36 be able to feed the wire 38 continuously and at a steady predetermined rate, and that the predetermined rate be adjustable to permit the manufacture of different alloys having different compositions.

The composition of the alloy ingredient wire 38 varies with the specific alloy being produced, and should contain the alloy ingredients in the exact ratios that are to be added to the base steel. For example, if tin is the only alloy being added to the base steel, then the alloy ingredient wire may include tin and no other alloy ingredients. Alternatively, if cobalt, titanium and nickel are to be added to the base steel, in equal amounts, then the alloy ingredient wire should include equal amounts of cobalt, titanium and nickel. Alternatively, a plurality of alloy ingredient wires 38 may be fed simultaneously to the alloy chamber 50, with one wire supplying the cobalt, one wire supplying the titanium, and one wire supplying the nickel.

The feed pipe 44 protects the alloy ingredient wire 38 from exposure to the molten base steel while the wire 38 is travelling between the wire feeder 36 and the alloying chamber 50. As shown in FIGS. 3 and 4, the feed pipe 44 includes an outer wall 46 of high temperature-resistant refractory material and an inner mesh or cage portion 48 of permanently mounted wire or screen material. The inner mesh or cage portion 48 defines a feed path 49 through which the alloy ingredient wire 38 may travel, and prevents the wire 38 from straying or touching the outer wall 46. The inner mesh or cage portion 48 and outer wall 46 also define a space 47 therebetween, through which an inert cooling fluid, for example, argon gas, may be injected.

Near the bottom of the feed pipe 44, the outer wall 46 curves inward, leaving a small opening 39 through which the wire 38 can travel. The opening 39 need only be larger than the diameter of the wire 38. Preferably, the inert cooling fluid enters the space 47 at the top of the feed pipe 44 and exits through the opening 39 at the bottom, at a sufficient velocity to both cool the wire 38 and prevent molten steel from entering the feed pipe 44 through the opening 39.

As shown in FIG. 1, the junction 51 between the outlet 39 of the feed pipe 44 and the inlet 56 of the alloying chamber 50 is not sealed from the molten base steel in the tundish vessel. Instead, there is a small area surrounding the junction 51 through which molten base steel may enter the alloying chamber through the inlet 56, along with the wire 38. This inflow of molten steel through the inlet 56 helps drag the alloy ingredient wire into the alloying chamber and facilitates rapid melting of the wire 38 so that the alloying ingredients can instantly mix with the base steel in the alloying chamber.

The base steel entering the alloying chamber 50 through the inlet 56 is at a higher elevation in the tundish than the base steel entering through the openings 58. For this reason, the opening 56 has a special configuration which facilitates the removal of inclusions from the base steel before it enters the alloying chamber. As shown in FIG. 5, the inlet opening 56 is "fluted", meaning that it has a plurality of closely spaced ridges, or peaks and valleys, extending from its outer perimeter. As molten base steel passes through the inlet 59, inclusions in the base steel become lodged and, in effect, trapped in the valleys 59 between the peaks 57 of the inlet 56, Eventually, the valleys 59 become filled with inclusions, and the alloying chamber 50, or at least the inlet portion 56 thereof, can be replaced.

The feeding speed of the alloy ingredient wire 38 is calculated as an appropriate weight percentage of the steady state flow rate of the molten base steel 32 entering and passing through the tundish 10 and into the alloying chamber 50, to give a steel alloy having the desired composition. These calculations are explained in detail in the Examples herein. Inside the alloying chamber 50, mixing of the base steel and alloy ingredients can be enhanced by bubbling argon gas or another suitable inert gas up through the drain nozzle 24 and into the alloying chamber 50, using techniques well known in the art. In other words, it is a standard practice in the art to bubble an inert gas up through the Gundish drain, to further homogenize the molten metal and to cause any remaining inclusions to rise back into the tundish. These same inert gas bubbling techniques can also be employed to facilitate mixing in the alloying chamber 50 in accordance with the invention. Referring to FIG. 1, argon gas may be injected using the inert gas purging nozzle 25 located just below the drain 24.

Other mixing techniques can also be employed to facilitate homogenization of the alloy ingredients with the base steel in the alloying chamber 50. For example, as shown in FIG. 1, an electromagnetic stirrer 27 may be located beneath the drain 24. The swirling action of molten metal caused by the electromagnetic stirrer carries up through the drain 24 and into the alloying chamber 50.

When switching production from one alloy to another, it is entirely unnecessary to disturb the steady state flow of base steel from the ladle and through the tundish, or to lower the level of liquid metal in the tundish. Instead, it is only necessary to change the type of alloying wire or wires originating from the one or more wire feeders 38. The time required to achieve steady state production of a new alloy is substantially reduced compared to prior art techniques, because the volume inside the alloying chamber is much less than the overall volume of the tundish. Accordingly, the amount of steel lost during transition is greatly reduced, and it becomes economically feasible for the steel producer to manufacture small order quantities of steel alloys.

A wide range of changes and modifications to the embodiment of the invention described above will be apparent to persons skilled in the art. The following examples are not to be construed as imposing limitations on the invention, but are included merely to illustrate preferred embodiments.

EXAMPLES 1–5

A large steel manufacturer receives five 50-ton orders for different grades of alloy steel. However, the smallest ladle located at the manufacturer's plant has a 280-ton capacity. The specifications for the five 50-ton orders are as follows, with all compositions defined in weight percent:

| Example | Fe | C | Mn | P | S | Si | Al | N | Alloys |
|---|---|---|---|---|---|---|---|---|---|
| 1 | Balance | .006–.10 | .20–.25 | up to .015 | up to .015 | up to .06 | .020–.050 | up to .006 | Ti .08–.12 |
| 2 | Balance | up to .008 | .45–.55 | up to .025 | up to .008 | .85–.95 | .33–.43 | up to .007 | Sn .055–.070 |
| 3 | Balance | up to .025 | .12–.17 | up to .010 | up to .010 | up to .020 | .030–.055 | up to .007 | Cr .05–.06 |
| 4 | Balance | .27–.32 | .65–.75 | up to .020 | up to .006 | .15–.30 | .035–.055 | up to .007 | Cd .002–.010 |
| 5 | Balance | up to .008 | .50–.60 | up to .020 | up to .015 | .30–.40 | .23–.28 | up to .006 | Sb .035–.045 |

The first step is to select a base grade of steel, free of alloys, whose composition for each of the minor elements (i.e. all elements except iron) is within or below the ranges for each of the alloy steel grades. For purposes of Examples 1–5, base steel having the following composition, for example, can be used:

| | | | |
|---|---|---|---|
| C - | .007 | Si - | .015 |
| Mn - | .15 | Al - | .035 |
| P - | .008 | N - | .005 |
| S - | .005 | Fe - | 99.775 |

The next step is to calculate the amounts of additional minor ingredients (including alloying ingredients) which need to be added to the base grade in order to make each of the steel alloy grades. Using the midpoint of each specification range as the target, the following additional amounts of minor ingredients will be needed:

| Example | C | Mn | P | S | Si | Al | N | Alloys |
|---|---|---|---|---|---|---|---|---|
| 1 | — | .08 | — | — | — | — | — | Ti .10 |
| 2 | — | .35 | — | — | .075 | .003 | — | Sn .63 |
| 3 | — | — | — | — | — | .008 | — | Cr .055 |
| 4 | .023 | .55 | — | — | .008 | .008 | — | Cd .006 |
| 5 | — | .40 | — | — | .020 | .220 | — | Sb .040 |

The next step is to calculate the compositions of the alloy ingredient wires that can be used to convert the base steel into the steel alloys for Examples 1–5. For Example 1, this is accomplished as follows:

$$\% \text{ Mn} + \% \text{ Ti} = 100$$

$$\% \text{ Mn} = \% \text{ Ti}\left(\frac{.08}{.10}\right)$$

$$\% \text{ Ti} = 55.55$$

$$\% \text{ Mn} = 44.45$$

For Example 2, the composition of the alloy ingredient wire is similarly determined:

$$\% \text{ Mn} + \% \text{ Si} + \% \text{ Al} + \% \text{ Sn} = 100$$

$$\% \text{ Mn} = \% \text{ Sn}\left(\frac{.35}{.63}\right)$$

$$\% \text{ Si} = \% \text{ Sn}\left(\frac{.075}{.63}\right)$$

$$\% \text{ Al} = \% \text{ Sn}\left(\frac{.003}{.063}\right)$$

$$\% \text{ Sn} = 59.55$$

$$\% \text{ Mn} = 33.08$$

$$\% \text{ Si} = 7.09$$

$$\% \text{ Al} = 0.28$$

Similar calculations for Examples 3–5 yield the following overall compositions for the alloy ingredient wires:

| Example | C | Mn | Si | Al | Alloys |
|---|---|---|---|---|---|
| 1 | — | 44.45 | — | — | Ti 55.55 |
| 2 | — | 33.08 | 7.09 | 0.28 | Sn 59.55 |
| 3 | — | — | — | 12.70 | Cr 87.30 |
| 4 | 3.87 | 92.44 | 1.34 | 1.34 | Cd 1.01 |
| 5 | — | 58.83 | 2.94 | 32.35 | Sb 5.88 |

The next step is to manufacture the alloy ingredient wires having the above compositions. These wires can be manufactured using techniques well known in the art for blending metals and making wires.

The next step is to calculate the feed rates for the alloy ingredient wires into the alloying chamber in the tundish, for making the steel alloys of Examples 1–5. The feed rates for the alloy ingredient wires are dependent on the steady state flow rate of the base steel into the tundish. For a tundish having a steady state flow rate of five tons per minute of base steel, the feed rates for the alloy ingredient wires and would be as follows, with the rates being in pounds per minute.

| Example | Base Steel | Alloys | Alloy Ingredient Wire |
|---|---|---|---|
| 1 | 10,000 | Ti (10.01) | 18.02 |
| 2 | 10,000 | Sn (63.40) | 106.46 |
| 3 | 10,000 | Cr (55.03) | 6.30 |
| 4 | 10,000 | Cd (0.60) | 59.41 |
| 5 | 10,000 | Sb (4.00) | 68.05 |

The final step is to manufacture the five grades of steel alloy. Base steel having the composition shown above is processed in the 280-ton ladle, and fed to a 50-ton tundish at a steady rate of 5 tons per minute. After steady state has been reached in the tundish, the alloy ingredient wire for Example 1 is fed through the feed pipe and into the alloying chamber at a rate of 18.02 pounds per minute, for about 10 minutes, to produce a 50-ton quantity of steel alloy. Then, after allowing for a brief transition time, the alloy ingredient wire for Example 2 is fed through the feed pipe and into the tundish alloying chamber at a rate of 106.46 pounds per minute, for about 10 minutes, to produce a 50-ton quantity.

Then, after allowing for a brief transition time, the alloy ingredient wire for Example 3 is fed through the feed pipe into the tundish alloying chamber at a rate of 6.30 pounds per minute, for about 10 minutes, to produce a 50-ton quantity. Then, after allowing for a brief transition time, the alloy ingredient wire for Example 4 is fed through the feed pipe into the tundish alloying chamber at a rate of 59.41 pounds per minute, for about 10 minutes, to produce a 50-ton quantity. Finally, after allowing for a brief transition time, the alloy ingredient wire for Example 5 is fed through the feed pipe into the tundish alloying chamber at a rate of 68.05 pounds per minute, for about 10 minutes, to produce a 50-ton quantity of steel alloy.

Argon gas is bubbled into the alloying chamber to facilitate mixing of the alloying ingredients with the base steel. The required flow rate of argon gas will vary depending on the feed rate of the alloy ingredient wire. To facilitate convenience, the manufacturer may set the argon gas flow at a single rate throughout the run, sufficient to mix the fastest of the five alloy ingredient wires with the base steel. As mentioned above, other mixing techniques, such as a magnetic stirrer, may also be employed.

The procedure explained in the above examples may be used to manufacture small quantities of other steel alloys as well, including, inter alia, steel alloys made using vanadium, cobalt, boron, molybdenum, copper, nickel, and/or any combination of alloying ingredients in an economical and efficient manner, using existing tundish and ladle equipment. In fact, there are no limits as to the ladle size or tundish size which can be used to practice the invention.

While the embodiments of the invention disclosed herein are presently considered to be preferred, various changes and modifications can be made without departing from the spirit and scope of the invention. The scope of the invention is indicated in the appended claims, and all changes that fall within the meaning and range of equivalents are intended to be embraced therein.

I claim:

1. An apparatus for making a steel alloy in a tundish, comprising:

a tundish vessel including one or more drains;

a ladle in communication with the tundish vessel for dispensing molten metal into the tundish vessel;

a chamber positioned inside the tundish vessel above and surrounding the drain;

a plurality of inlets leading into the chamber;

a feed pipe communicating with at least one of the inlets; and a device for dispensing an alloying material through the feed pipe and into the chamber.

2. The apparatus of claim 1, wherein the chamber comprises an inverted conical wall portion, a flange at the base of the wall, an alloying material feed inlet at the top of the wall, and one or more base steel feed inlets in the wall.

3. The apparatus of claim 1, further comprising at least one inlet for supplying an inert gas to the chamber.

4. The apparatus of claim 1, further comprising a stirring device for stirring liquid metal in the chamber.

5. The apparatus of claim 1, wherein the device for dispensing an alloying material comprises a wire feeder.

6. The apparatus of claim 1, wherein the feed pipe comprises an outer wall, an inner cage defining a feed path for the alloying material, and a space between the outer wall and inner cage for receiving cooling fluid.

7. An apparatus for making a steel alloy in a tundish, comprising:

a tundish vessel including one or more drains;

a ladle in communication with the tundish vessel for dispensing molten metal into the tundish vessel;

a chamber smaller than the tundish vessel above and surrounding at least one of the drains, and in communication with said tundish vessel and said at least one of the drains;

a feed device communicating with the chamber; and a device for dispensing an alloying material into the chamber using the feed device.

8. The apparatus of claim 7, wherein the chamber comprises an inverted conical wall portion, a flange at the base of the wall, an alloying material feed inlet at the top of the wall, and one or more base steel feed inlets in the wall.

9. The apparatus of claim 8, wherein the alloying material feed inlet comprises a fluted opening.

10. The apparatus of claim 8, wherein the flange fits snugly around an upper lip of a drain nozzle in the drain.

11. The apparatus of claim 7, wherein the feed device comprises a feed pipe extending from the dispensing device to the chamber.

12. The apparatus of claim 7, further comprising at least one inert gas inlet for supplying inert gas into the chamber.

13. The apparatus of claim 12, wherein the inert gas inlet comprises a drain nozzle in the drain.

14. The apparatus of claim 7, further comprising an electromagnetic stirrer for mixing base steel with alloying material in the chamber.

* * * * *